US005102136A

United States Patent [19]

Heidel et al.

[11] Patent Number: 5,102,136

[45] Date of Patent: Apr. 7, 1992

[54] SLOT MACHINE REEL MOUNTING ASSEMBLY

[75] Inventors: Raymond Heidel, Henderson, Nev.; Walerian Kojro, Glenview; Herbert Hausmann, Prairie View, both of Ill.; Kenneth B. Turnbaugh, Las Vegas, Nev.

[73] Assignee: Bally Manufacturing Corporation, Chicago, Ill.

[21] Appl. No.: 650,356

[22] Filed: Feb. 4, 1991

[51] Int. Cl.[5] ..... A63F 5/04

[52] U.S. Cl. ..... 273/143 R

[58] Field of Search ..... 273/143 R, 138 A

[56] References Cited

U.S. PATENT DOCUMENTS

| | | | |
|---|---|---|---|
| 3,610,629 | 10/1971 | Pecksen | 273/143 R |
| 3,910,582 | 10/1975 | Richards | 273/143 R |
| 3,913,922 | 10/1975 | Richards | 273/143 R |
| 4,037,845 | 7/1977 | Hooker | 273/138 A |
| 4,071,246 | 1/1978 | Hooker | 273/143 R |
| 4,200,291 | 4/1980 | Hooker | 273/143 R |
| 4,249,737 | 2/1981 | Hancherick | 273/143 R |
| 4,261,571 | 4/1981 | Ito | 273/143 R |
| 4,262,906 | 4/1981 | Heywood | 273/143 R |
| 4,358,114 | 11/1982 | Burnside | 273/143 R |
| 4,410,178 | 10/1983 | Partridge | 273/143 R |
| 4,430,903 | 2/1984 | Hooker et al. | 74/153 |
| 4,440,036 | 4/1984 | Hooker et al. | 74/153 |
| 4,505,167 | 3/1985 | Nicolaus | 74/577 |
| 4,635,937 | 1/1987 | Dickinson et al. | 273/143 R |
| 4,637,611 | 1/1987 | Hamada | 273/143 R |
| 4,669,731 | 6/1987 | Clarke | 273/143 R |
| 4,711,452 | 12/1987 | Dickinson et al. | 273/143 R |
| 4,773,648 | 9/1988 | Itoh | 273/143 R |
| 4,874,173 | 10/1989 | Kishishita | 273/143 R |

*Primary Examiner*—Benjamin Layno
*Attorney, Agent, or Firm*—Jenner & Block

[57] ABSTRACT

A reel mounting assembly for a slot machine is disclosed. The reel mounting assembly includes a frame for supporting a reel. An actuator is provided to adjust the position of the reel when the reel is inserted into the slot machine. The reel mounting assembly includes a base plate having two rows of slots for engagement with at least one finger on the frame. Furthermore, a stepper motor, a computer, and a reel controller board are provided to control the rotation of said reel. The stepper motor and reel controller board are secured to the frame.

23 Claims, 3 Drawing Sheets

FIG. 1
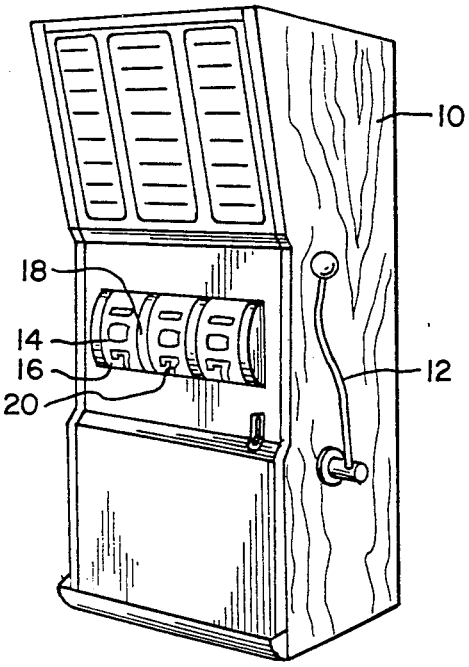
FIG. 2
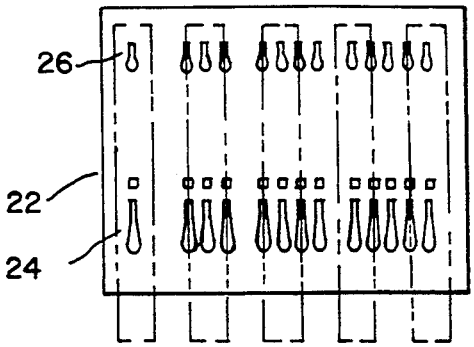
FIG. 3
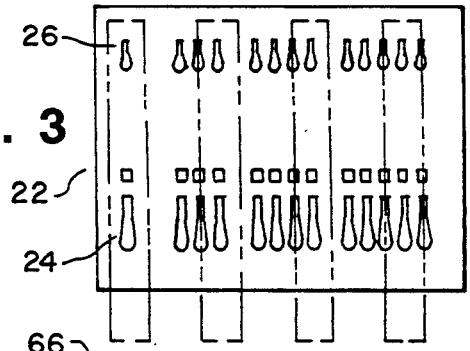
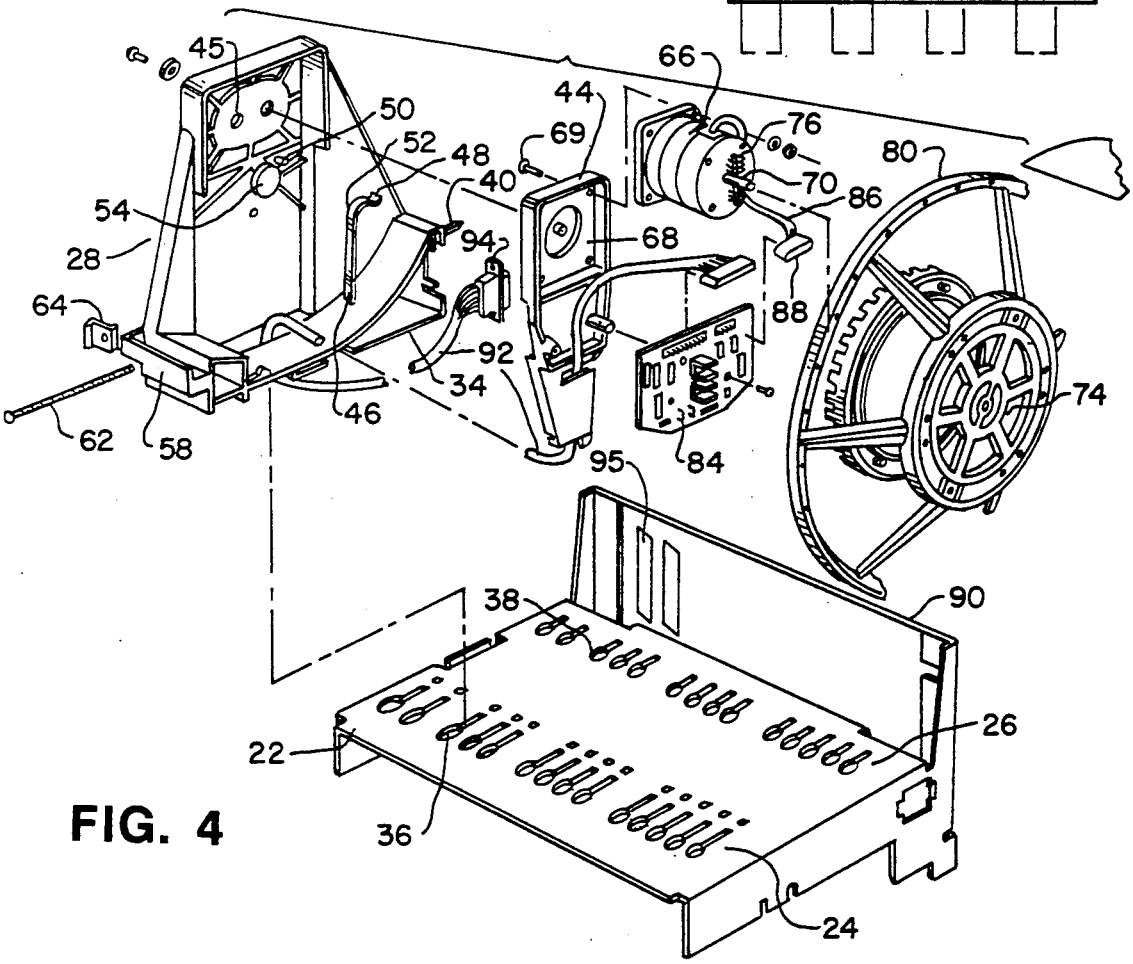
FIG. 4

SLOT MACHINE REEL MOUNTING ASSEMBLY

TECHNICAL FIELD

The invention relates to the field of slot machines and in particular to the field of slot machine reel mounting assemblies.

BACKGROUND OF THE INVENTION

Traditionally, slot machines include a number of rotating reels each having an outer circumferential reel strip printed with a number of play symbols usually consisting of items such as pictures of fruit, playing cards or other symbols. The reels are located in a side by side relationship for independent movement about a common axis. In the more modern machines each of the reels are driven individually by a stepper motor that serves to rotate the reels about the common axis.

Slot machine play is initiated when a player either pulls a handle or pushes a button on the slot machine. Such player action, in turn, triggers the start of the reel motors which rotate the reels. The reels are then stopped at random positions usually under control of a microprocessor. Upon completion of the rotation of all of the reels, the machine determines if the player has won a payout according to the given combinations of the play symbols displayed along a pay line.

In order to house the reels, conventional slot machines require a housing having a depth sufficient to accommodate the reels. These reels can be mounted on modules or reel mounting mechanisms which can each be separately inserted into the housing. Upon insertion, it has been conventional to secure the module to the housing by bolting the module to an internal structure in the housing and then to cable or provide electrical connections to a reel motor and other electronic components. In addition to being relatively expensive to manufacture, it is usually a very cumbersome procedure to remove these modules from the housing for maintenance or modifications of the machines.

Moreover, the reels mounted on the modules should have precise alignment with the pay line located on a reel display window. The modules, are secured next to each other, as noted above, in a side by side relationship for independent reel movement about a common axis. This has created certain difficulties during the manufacture and maintenance of slot machines utilizing such modules. For example, one of the major problems is to accurately align the centers of the play symbols with the pay line. In most slot machines this requires a time consuming and tedious adjustment of a number of inaccessible elements within the machine housing. As a result, adjusting the alignment of the reels during the manufacture of slot machines as well as the maintenance of slot machines presents significant problems to the industry.

SUMMARY OF THE INVENTION

It is therefore an object of the present invention to provide a reel mounting assembly for a slot machine having a mechanism for adjusting the rotational position of the reel from the front of the machine so as to align play symbols on the reel with a pay line.

It is an additional object of the present invention to provide a means for easily inserting and removing the reel mounting assembly from a support frame in a slot machine.

It is a further object of the present invention to provide a slot machine reel mounting assembly which includes a reel support member pivotally connected to an upright support member. A reel and a motor are then rotatably mounted to the reel support. To urge the reel support to a front of the upright support, a spring is secured to the upright support member to apply a forward bias force to the reel support member. To counteract the effect of the spring on the reel support member, an actuator screw engaging the reel support member is mounted on the front of the upright support member. The actuator serves to position the reel support member with respect to the upright support member thereby providing a means for adjusting the rotational position of the reel with regard to the pay line. After the actuator has been used to place the reel into the desired position, the actuator is held in place by the tension of the spring thereby preventing any further rotational movement of the reel until, of course, the user desires to adjust the location of the reel with respect to the pay line again.

It is an additional object of the present invention to provide a slot machine reel mounting assembly having an upright support member and a plurality of projections to secure the upright support member to a base member in the housing of a slot machine. In addition, a reel support member pivotally connected to the upright support member is provided and a reel is rotatably mounted to the reel support member. To urge the reel support member to the front of the upright support member, a spring is secured to the upright support member. To counteract the effect of the spring, an actuator bolt engaging the reel support member is mounted on the front of the upright support member. The actuator bolt in cooperation with the spring maintains in position the reel support member with respect to the upright support member thereby providing a means for adjusting the position of the reel with regard to the pay line. After the actuator bolt has been used to adjust the reel support member and thus the reel in the desired position, the actuator is held in place by the tension of the spring thereby preventing further rotational movement of the reel until the user wishes to adjust the location of the reel with respect to the pay line.

It is a further object of the present invention to provide a slot machine reel mounting assembly which includes a reel support member pivotally connected to an upright support member. A reel and a motor are then rotatably mounted to the reel support. To urge the reel support to a front of the upright support, a spring is secured to the upright support member to apply a forward bias force to the reel support member. To counteract the effect of the spring on the reel support member, an actuator screw engaging the reel support member is mounted on the front of the upright support member. The actuator serves to position the reel support member with respect to the upright support member thereby providing a means for adjusting the rotational position of the reel with regard to the pay line. After the actuator has been used to place the reel into the desired position, the actuator is held in place by the tension of said spring thereby preventing any further rotational movement of the reel until, of course, the user desires to adjust the location of the reel with respect to the pay line again. To control the rotation of the reel, a control means is operatively connected to the reel in order to provide a means to control the rotation of said reel.

It is an additional object of the present invention to provide a base plate having a two rows of slots serially aligned to receive at least one upright support member.

BRIEF DESCRIPTION OF THE DRAWINGS

FIG. 1 is a perspective view a conventional slot machine;

FIG. 2 is a top view of a base plate according to an embodiment of this invention;

FIG. 3 is a top view of the base plate of FIG. 2 showing a different alignment of reels;

FIG. 4 is an exploded view of a reel mounting assembly according to an embodiment of the invention;

DETAILED DESCRIPTION OF THE INVENTION

Figure 5:
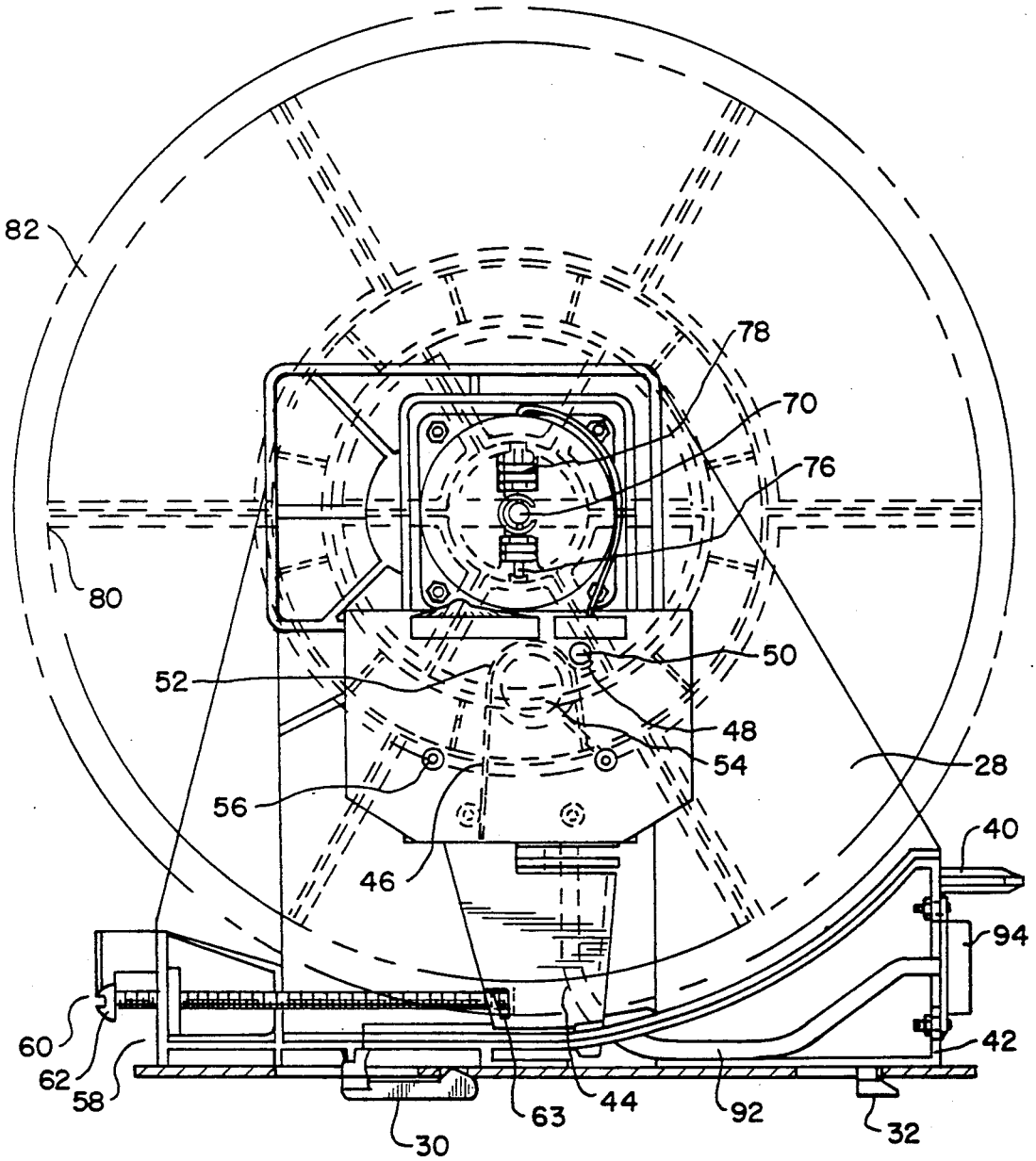
FIG. 5 is a cut away side view of the reel mounting assembly in FIG. 4.

A conventional slot machine having a housing 10, as illustrated in FIG. 1, normally uses a handle 12 or push button (not indicated in the drawings) to initiate operation of the slot machine. The user pulls the handle 12 or pushes a button thereby setting into rotation a group of symbol bearing reels shown generally at 14. Upon completion of the operation, the reels 14 come to a stop and display in a display window 16 configured in the front of the housing 10 the results of that particular operation. A pay line 18 on the window 16 is used to indicate the winning positions of the play symbols 20 on the reels. The reels 14 are secured within the slot machine housing 10.

FIG. 2 shows one component used in a method of mounting the reels 14 to the slot machine's internal frame. This component is a base plate 22 which is secured horizontally within the housing The base plate 22 is configured with a first and second row of slots 24 and 26. The slots in the first row 24 are axially aligned with the slots in the second row 26.

Figure 6:
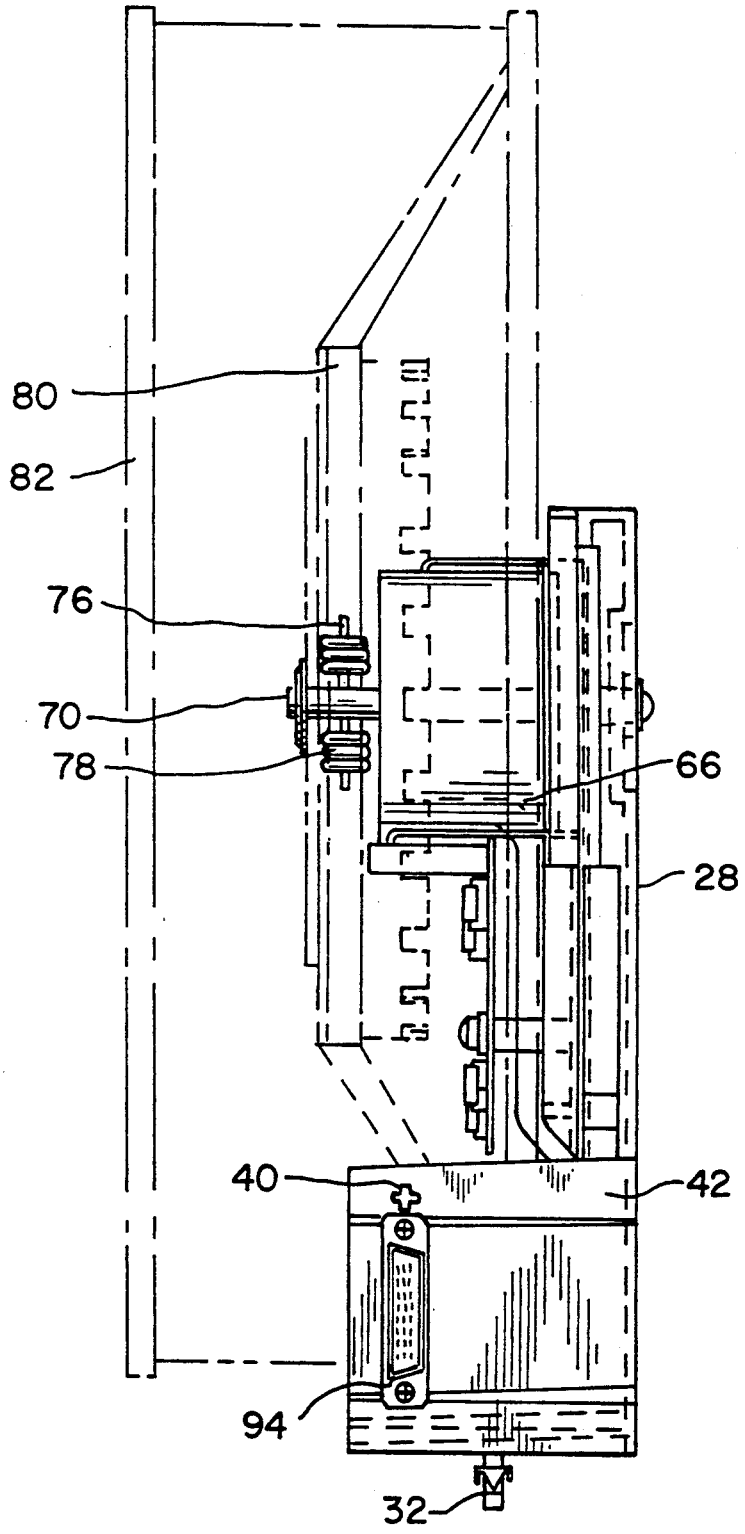
FIG. 6 is a cut away front view of the reel mounting assembly of FIG. 4.

As best seen in FIGS. 4, 5 and 6, an upright support member 28 is provided to support each of the reels 14 and is mounted onto base plate 22. The support 28 has a pair of projections 30 and 32 located on a bottom offset portion 34 of the support 28. The first projection 30 is inserted into a first slot 36 in the first row 24 and a second projection 32 is inserted into a second slot 38 in the second row 26 which is axially aligned with the slot 36 in which the first projection 30 was inserted. Each projection 30 and 32 slides beneath and engages the base plate 22. Thus, by inserting the projections 30 and 32 into the two slots 36 and 38, the reel support 28 is secured to the base plate 22. In addition, a horizontal projection 40 located on a back portion 42 of the support 28 is inserted into the internal frame or a back panel thus further securing the support 28 within the housing 10. This arrangement provides substantial advantages in that to remove the support 28 from the base plate 22 all that is required is to pull the support 28 forward and disengage the projections 30 and 32 from the slots 36 and 38 in which they were inserted.

According to this embodiment of the invention, the user can arrange a number of reels 14 to his preference. For example, FIGS. 2 and 3 show two different possible arrangements of reels as illustrated by the broken lines representing a number of the upright supports 28. To do so, the user simply inserts the support 28 upon which the reel is mounted into any two axially aligned slots. Limited only by the number of slots 24 and 26 in the base plate 22 and the size of reels that he wishes to use in the slot machine 10, the user can choose a variety of reel arrangements. As a result, it is possible to quickly and conveniently change the reel configuration of a slot machine 10, for example, from the five reel machine in FIG. 2 to the four reel machine in FIG. 3.

As illustrated in FIGS. 3, 4 and 5, the reel 14 is attached to a reel support member 44 which, itself, is pivotally mounted in one of two holes shown generally at 45 to the upright support 28. The offset holes 45 provide a means to insert reels of different diameters into housing 10 and the pivotable reel support 44 provides a mechanism for adjusting the rotational position of the mounted reels 14 so as to rotationally align the symbols on the reels 14 with the pay line 18 when the reels 14 are stopped. To position the reel 14 with respect to the upright support 28 thereby aligning the symbols 20 on the reel 14 with the pay line 18, a spring 46 is used to bias the angular position of the pivotal reel support 44 in a forward direction with respect to the support member 28. The spring 46 has an upper lip 48 which engages a first boss 50 on support 28. An upper arcuate portion 52 of the spring 46 depending from the upper lip 48 engages a second boss 54 on support 28. Together, the first boss 50 and the second boss 54, cooperate to secure the spring 46 to the support 28. The spring 46 also engages a post 56 located on the inside of the reel support 44 thereby biasing the reel support 44 towards the front portion 58 of the reel support 24. Although not indicated in the drawings, the spring 46 is initially secured to the post 56 by inserting a rod, or screwdriver, or the like through a hole during assembly of the mechanism show in FIG. 4. This tool is used to temporarily engage the spring 46 until it can be properly positioned against the post 56 while the reel support shaft is being inserted into one of the holes 45.

The rotational position of the reel support 44, and hence the symbols 20 with respect to the support 28, can be adjusted by utilizing an adjustment mechanism shown generally, at 60. It is readily evident that a variety of mechanisms 60, capable of adjusting the reel support position, can be utilized in conjunction with this embodiment of the invention. But in the preferred embodiment, the actuator 60 consists of a bolt 62 inserted through an aperture in the support 28 with its end received by a receptacle 63 in the reel support 44. To retain the position of the bolt 62 and, therefore, the angular position of the reel support 44, an internally threaded fastener 64 is inserted into a notch (not indicated in the drawings) in a front portion 58 of the support 28. The bolt 62 is threaded into the fastener 64 thereby preventing linear movement of the bolt 62. However, the rotational position of the reel 14 can be adjusted by simply rotating the bolt 62 hence pivoting the reel support 44 toward the back 42 of the support 28 or by rotating the bolt 62 in the other direction and thus permitting the reel support 44 to move towards the front 58 of the support 28. Rotational movement of the reel support 44 is effectively prevented after adjustment by the actuator 60 because of the forward biasing effect of the spring 46.

A stepper motor 66 including a motor shaft 70 is secured, preferably by bolts 69, to the upper portion of the reel support 44 as generally indicated by 68. The motor 66 as is conventional in slot machines rotates the reel 14 about a horizontal axis 74. Secured perpendicularly to the shaft 70 is a laterally extending pin 76 about which are mounted a plurality of O-rings 78. To impart rotational motion to the reel 14 which comprises a rim 80 supporting a reel strip 82 having the symbols 20 printed on the outer surface, the laterally extending pin 76 together with the O-rings 78 are inserted into a transverse slot (not indicated in the drawings) on rim 80 thereby providing a means to connect the reel 14 to the motor 66. The reel 14, thus, will rotate with the shaft 70 of the motor 66.

To control rotation of the reel 14, the motor 66 is operatively connected to a computer (not illustrated in the drawings). A reel controller board 84, secured to the reel support 44, is connected to the motor 66 by a first cable 86. The first cable 86 has a first connector 88 connecting the cable 86 to the reel controller 84 and a motor connector (not indicated in the drawings) joining the cable 86 to the motor 66. The reel controller board 84, is in turn, connected to a backplane 90 via a second cable 92. A connector 94 attaches the second cable 92 to a receptacle 95 on the backplane 90. As can be seen in FIGS. 5 and 6, the connector 94 is set in a slot in the rear portion of the support 28. By being so positioned, the connector 94 connects the backplane 90 to the reel controller board 84, but also helps to secure the support 28 to the base frame 96 which, as shown sectioned away from in FIG. 4, also supports the backplane 90 and the base member 22. It will be appreciated that this arrangement using the connector 94 facilitates assembly of the slot machine 10 and replacement of reels 14 since an assembly support 28 will plug directly into the backplane 90 without the need of extensive disassembly and reassembly.

We claim:

1. A slot machine having a housing and a pay line with a reel mounting assembly comprising:

an upright support member;

a reel support member pivotally connected to said upright support member;

a reel rotatably mounted to said reel support member; and adjustment means for adjusting the rest rotational position of said reel with respect to said pay line, said adjustment means includes an actuator mounted on a front side of said upright support member engaging said reel support member, said actuator biasing said reel support member toward a back side of said upright support member thereby providing a means for fixedly adjusting the position of said reel by biasing said reel support member.

2. The assembly of claim 1 wherein said adjustment means further includes a biasing member mounted on said upright support member for applying a biasing force to said reel mounting member to bias it towards said front side of said upright support member.

3. The assembly of claim 2 wherein said actuator includes a bolt extending from said front side of said upright support member and engaging said reel support member.

4. The assembly of claim 3 wherein said actuator further includes a fastener securing said bolt in a fixed position, said fastener being secured to said upright support member.

5. The assembly of claim 4 wherein said reel support member further includes a receptacle for receiving said bolt.

6. The assembly of claim 1 further including a motor mounted to said reel mounting member, said motor providing a means to rotate said reel.

7. The assembly of claim 6 wherein said motor is a stepper motor.

8. The assembly of claim 1 wherein said upright support member further includes at least one projection extending from a bottom portion of said upright support member, said projection configured to engage and secure said assembly to said slot machine.

9. The assembly of claim 1 wherein said upright support member further comprises at least one projection extending from a back side of said upright support member, said projection configured to engage and secure said mechanism to said slot machine.

10. A slot machine having a housing and a payline with a reel mounting assembly comprising:

a base plate secured to housing having a plurality of slots;

at least one upright support member having at least one projection extending from a bottom portion of said upright support member, said projection engaging a slot to secure said frame to said base plate;

a reel support member pivotally connected to said upright support member;

a reel rotatably mounted to said reel support member; and adjustment means for adjusting the rest position of said reel with respect to said pay line, said adjustment means includes an actuator mounted on a front side of said upright support member engaging said reel support member, said actuator biasing said reel support member toward a back side of said upright support member thereby providing a means for fixedly adjusting the position of said reel by biasing said reel.

11. The assembly of claim 10 wherein said adjustment means further includes a member mounted on said upright support member for applying a biasing force to said reel support member to bias it towards said front side of said upright support member.

12. The assembly of claim 11 wherein said slots of said base plate are horizontally aligned in a first row near a front side of said plate and a second row near a back side of said plate.

13. The assembly claim 12 wherein said slots in said first row are axially aligned with said slots in said second row.

14. The assembly of claim 13 wherein a first projection is located at a front portion of said bottom portion and a second projection is located at a back portion of said bottom portion, said first projection engaging a slot in said first row, said second finger engaging a slot in said second row.

15. The assembly of claim 14 wherein said actuator comprises a bolt extending from said front of said upright support member and engaging said reel support member.

16. The assembly of claim 15 wherein said actuator further comprises a fastener securing said bolt in a fixed position, said fastener being housed in said upright support member.

17. The assembly of claim 16 wherein said reel support member further comprises a receptacle for receiving said bolt.

18. The assembly of claim 10 further comprising a motor mounted to said reel support member thereby providing a means to propel said reel.

19. The assembly of claim 10 wherein said upright support member further comprises at least one projection extending from said back side, said projection configured to engage and secure said assembly to said slot machine.

20. A slot machine having a housing and a pay line with a reel mounting assembly comprising:

an upright support member;

a reel support member pivotally connected to said upright support member;

a reel rotatably mounted to said reel support member;

adjustment means for adjusting the rest rotational position of said reel with respect to the pay line, said adjustment means includes an actuator mounted on a front side of said upright support member engaging said reel support member, said actuator biasing said reel support member toward a back side of said upright support member thereby providing a means for fixedly adjusting the position of said reel by biasing said reel support member; and control means operatively connected to said reel thereby providing a means to control the rotation of said reel.

21. The assembly of claim 20 wherein said control means includes a backplane operatively connected to said reel.

22. The assembly of claim 21 wherein said control means further includes a reel controller board secured to said reel mounting assembly, said reel controller board operatively connected to said backplane and to said reel.

23. The assembly of claim 22 wherein said wherein said means operatively connecting said backplane to said reel controller board includes a connector connecting said means to said backplane wherein said connector engages said controller board thereby securing said reel mounting assembly to said backplane.

* * * * *